US006702662B2

(12) United States Patent
Kristensson

(10) Patent No.: US 6,702,662 B2
(45) Date of Patent: Mar. 9, 2004

(54) METHOD FOR PROVIDING CLEAN AIR IN PREMISES AND DEVICE FOR CARRYING THROUGH SAID METHOD

(76) Inventor: Jan Kristensson, Syrénvägen 1, Ängelholm S-262 65 (SE)

( * ) Notice: Subject to any disclaimer, the term of this patent is extended or adjusted under 35 U.S.C. 154(b) by 0 days.

(21) Appl. No.: 10/296,515

(22) PCT Filed: May 30, 2001

(86) PCT No.: PCT/SE01/01199

§ 371 (c)(1),
(2), (4) Date: Nov. 25, 2002

(87) PCT Pub. No.: WO01/94853

PCT Pub. Date: Dec. 13, 2001

(65) Prior Publication Data

US 2003/0153260 A1 Aug. 14, 2003

(30) Foreign Application Priority Data

Jun. 5, 2000 (SE) ..... 0002069

(51) Int. Cl.[7] ..... F24F 3/16

(52) U.S. Cl. ..... 454/187; 55/385.2; 454/189

(58) Field of Search ..... 454/49, 63, 64, 454/187, 188, 189; 128/205.29, 205.12, 205.27; 55/385.2, 467.1

(56) References Cited

U.S. PATENT DOCUMENTS 3,107,863 A * 10/1963 Potapenko ..... 362/96
3,385,036 A 5/1968 Webb
4,841,847 A * 6/1989 Hirayama ..... 454/187
4,890,544 A 1/1990 Aalto et al.
5,167,577 A 12/1992 Kristensson
5,264,015 A * 11/1993 Matsui ..... 55/467
6,241,598 B1 * 6/2001 Kleissler, Jr. ..... 454/60

FOREIGN PATENT DOCUMENTS

DE 2356780 A1 5/1975
DE 34 37 964 * 4/1986 ..... 454/189
JP 6-137624 * 5/1994 ..... 454/187
SE 9002712-9 8/1994
WO WO 01/94853 A1 12/2001

* cited by examiner

*Primary Examiner*—Harold Joyce
(74) *Attorney, Agent, or Firm*—Tarolli, Sundheim, Covell & Tummino L.L.P.

(57) ABSTRACT

The present invention relates to a method and a device for providing clean air in premises, wherein impure air is received or taken in into an air treatment device (1) from lower portions of the premises and cleaned or purified therein. A first partial flow (DS1) of air received or taken in into the air treatment device (1) is cooled, while a second partial flow (DS2) of air received or taken in into said air treatment device (1) is heated. The cooled air (KL) in the first partial flow (DS1) is brought to flow, through at least one cell body member (17) in at least one air discharge unit (15), slowly downwards without substantial co-ejection of surrounding air to define at least one zone of clean air (RZ) in the premises beneath the air discharge unit (15). The heated air (VL) in the second partial flow (DS2) is discharged, through an air discharge opening (16), in an upwards direction such that said heated air (VL) rises in the premises at low speed.

39 Claims, 3 Drawing Sheets

METHOD FOR PROVIDING CLEAN AIR IN PREMISES AND DEVICE FOR CARRYING THROUGH SAID METHOD

The present invention relates to a method for providing clean or pure air in premises, wherein unclean or impure air is received in an air-treatment device from lower portions of the premises and cleaned or purified therein. The invention further relates to a device for carrying through said method.

In the publication SE, C2, 500 707 there is described a device for feeding air to a treatment area in premises. This device however, does not allow generation of a particular zone of clean air in the premises while simultaneously feeding clean air to the remaining parts of said premises.

The object of the present invention has been to eliminate this problem and this is done by providing the method according to the invention with the characterizing measures of subsequent claim 1.

A device for carrying through said method is given the characterizing features of subsequent claim 22.

By means of the method and device according to the invention, it is possible to generate at least one particular zone of clean air in the premises while at the same time providing the rest of the premises with clean air.

The invention will be further described below with reference to the accompanying drawings, in which FIG. 1 schematically illustrates premises with a device according to the invention;

Figure 1:
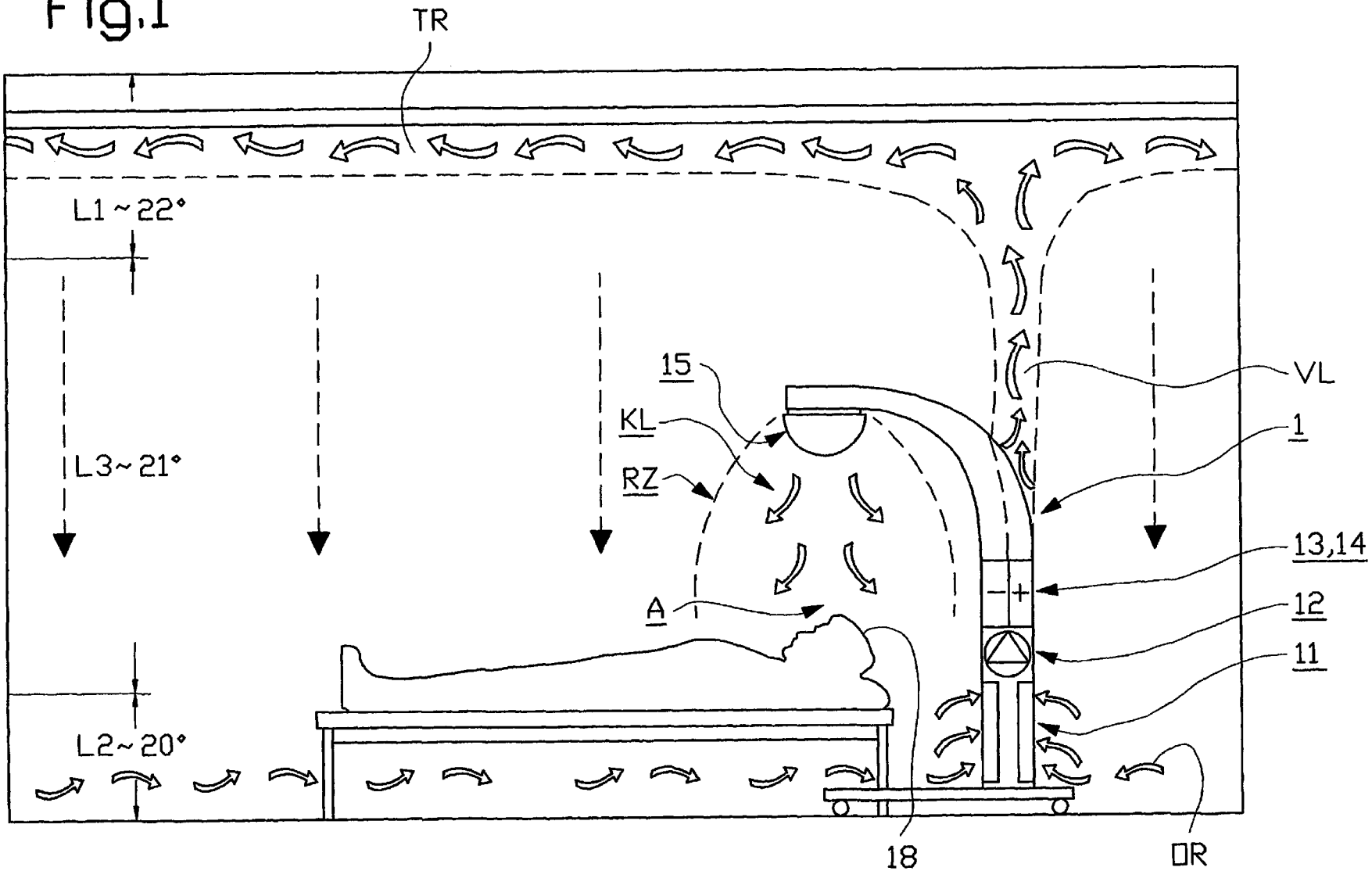

In FIG. 1 there is illustrated an air treatment device 1 having a chassis 2 with driving wheels 3 for moving the air treatment device 1 around on the floor 4 in premises. A column 5 provided on the chassis 2 includes a vertical member 6 which at the top changes into a lateral member 7. The vertical member 6 has down below two air intake openings 8, 9 for inlet of impure air OR from floor level in the premises into an air passage 10 in the column 5.

In the air passage 10 there is located, closest to the air intake openings 8, 9, an air cleaning or purifying device 11 of a suitable type, e.g. two filter devices 11*a*, 11*b* to give the intake air a desired degree of purity. In the air passage 10 there is provided, after the air cleaning device 11, a fan device 12 for sucking air into and bring it flow through the air passage 10 and further through the air treatment device 1.

The air passage 10 is divided into at least a first and a second passage branch 10*a*, 10*b*. A first partial flow DS1 of the purified air RL is brought to flow through the passage branch 10*a* and a second partial flow DS2 of the purified air RL is brought to flow through the passage branch 10*b*. In the first passage branch 10*a* there is located a cooling device 13 for cooling the first partial flow DS1 and said passage branch 10*a* is provided to guide cooled air KL to at least one air discharge unit 15 which is located on the underside of the lateral member 7. In the second passage branch 10*b* there is located a heating device 14 for heating the second partial flow DS2 and the second passage branch 10*b* is provided to guide the heated air VL from the heating device 14 to at least one air discharge opening 16 or corresponding means for the discharge of heated air VL.

Figure 2:
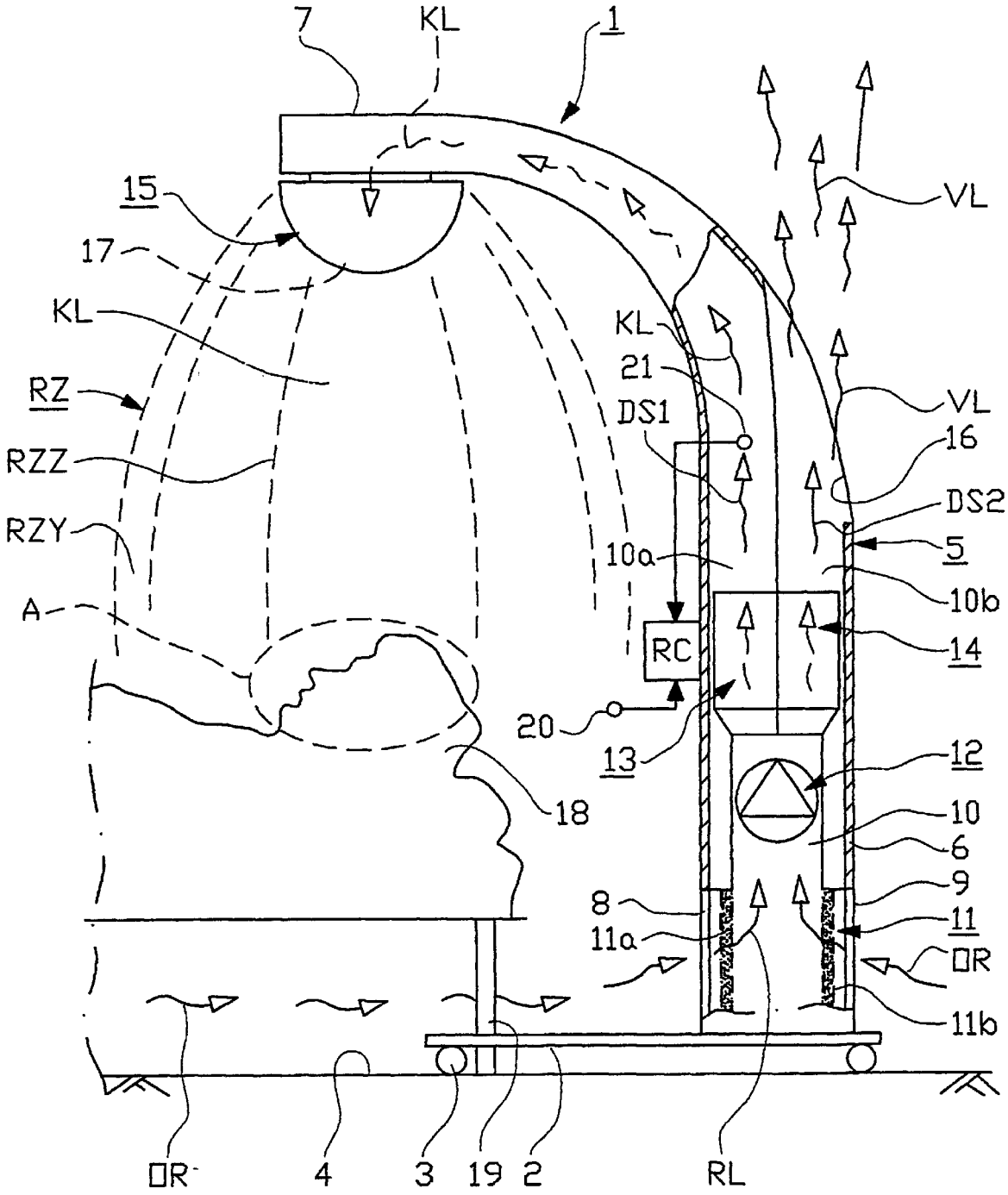
FIG. 2 is a side view, partly in section, of a device according to the invention.

As is apparent from FIGS. 1 and 2, the air discharge unit 15 and the air discharge opening 16 are provided on opposite parts of the air treatment device 1 and at substantial distance from each other, namely such that the cooled and the heated air flow out into different parts of the premises. Thus, the air discharge unit 15 discharges cooled air KL to generate at least one zone of clean or pure air RZ beneath said air discharge unit 15 on one side of the air treatment device 1, while the air discharge opening 16 is provided on an opposite side of the air treatment device 1 such that it discharges heated air VL in a direction upwards towards the ceiling region TR in the premises at a substantial distance from the clean air zone RZ.

The cooling device 13 is provided to cool the first partial flow DS1 to such temperature relative to the temperature of the air in the premises where the cooled air KL shall be discharged, that said cooled air KL will sink slowly, through a cell body member 17 forming part of the air discharge unit 15, for generating the zone of clean air RZ without thereby substantially co-eject impure air from the surroundings into the zone of clean air RZ and preferably without generating substantial turbulence in the air in the premises.

The heating device 14 is provided to heat the second partial flow DS2 to such temperature relative to the temperature of the air in the premises where the heated air VL shall be discharged, that said heated air VL slowly rises upwards towards the ceiling region TR of the premises without thereby causing substantial turbulence in the air in said premises.

The zone of clean or pure air RZ may constitute or define parts of a breathing zone A for a person 18 which e.g. lies on a bed 19 or similar, but said zone of clean air RZ may also be another zone where clean air is needed, e.g. a working zone wherein work is done.

Figure 3:
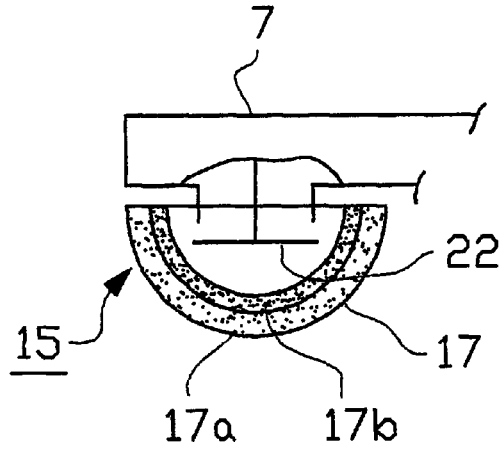
FIG. 3 is a section of an air discharge or air emitting unit forming part of the device of FIG. 1.
Figure 4:
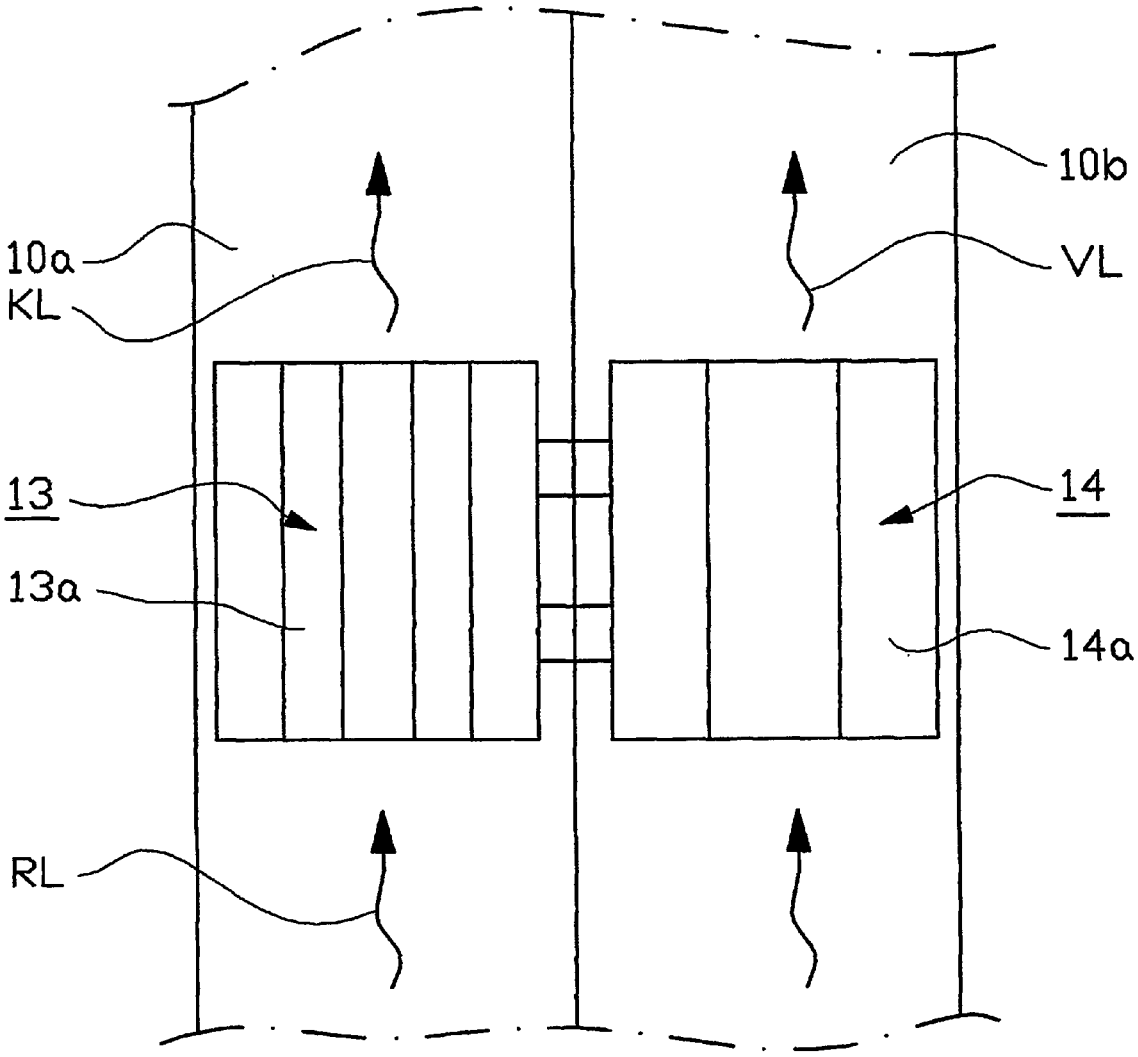
FIG. 4 schematically illustrates a cooling device forming part of the device of FIG. 1.

The cooling device 13 may be a thermoelectric device with Peltier-effect, i.e. an effect which is generated when an electric current is sent through two metals which are in contact with each other. In the contact surface, cooling is thereby obtained. In FIG. 3, there is schematically shown such a thermoelectric device with cooling members 13*a* and heat emitting or exothermal members 14*a*. The cooling members 13*a* are in this case the cooling device 13 from which the cooled air KL is discharged and the heat emitting members 14*a* are defined by the heating device 14 from which the heated air VL is discharged.

The cooling device 13 may be controlled by a control device RC which cooperates with a transmitter 20 which is situated on the same or substantially the same level as the breathing zone A or similar and preferably at a location or point outside said zone.

The control device RC cooperates with a transmitter 21 which is situated in the air passage branch 10*a* downstream of the cooling device 13. The transmitter 21 is adapted to measure the temperature at said level and, based on the measurement result, transmit a signal to the control device RC. The control device is adapted to control the cooling device 13 based on the temperature at said level. The transmitter 21 is preferably a set point transmitter which is set or adjusted to a certain set point temperature for the processing air.

The fan device 12 is adapted to bring the processing air to flow through the air treatment device 1 such that the air flow overcomes the resistances therein, but not such that the air flow is pressed or forced out through the air discharge unit 15. Hereby, it is guaranteed that the air discharged from the air discharge unit 15 does not become substantially turbulent and does not co-eject impure air from the surroundings.

The cell body member 17 of the air discharge unit 15 preferably has a porous outer cell body layer 17*a* and a porous inner cell body layer 17*b*. The outer cell body layer 17*a* is preferably harder and has larger pores than the inner cell body layer 17*b* such that said outer cell body layer 17*a* defines a supporting part of the cell body member 17 and provides for a smaller fall of pressure for the passing processing air than the inner cell body layer 17*b*.

In the cell body member 17 there is preferably provided an air guide means 22 which, relative to the incoming flow of processing air, has a transverse member and which is vertically adjustable relative to the cell body member 17. This air guide means 22 is adapted to guide the air flowing into the cell body member 17 relative to the various portions of said cell body member 17.

The air discharge unit 15 may be mounted on the lateral member 7 of the column 5 by means of a bayonet fixing (not shown) or by means of another coupling device.

The device described above operates as follows:

The first partial flow DS1 is cooled in the cooling device 13 to a temperature which is lower, e.g. 1–3° C. lower than the temperature measured by the transmitter 20 in level with the breathing zone A or similar, and is brought to flow through the cell body member 17 of the air discharge unit 15 in such a way that the rate of fall of the cooled air KL becomes low. This cooled air KL gets such an extension or spreading that an outer zone RZY does not substantially co-eject impure air and prevents thereby impure air from being mixed with the clean air zone RZ and particularly with a central part RZZ thereof. Hereby, air in said central part RZZ of the clean air zone RZ can be brought to have substantially the same degree of purity as the clean air RL immediately after or downstream of the air cleaning device 11. Thus, the degree of purity of the air in the zone of clean air RZ becomes substantially the same as immediately after the air cleaning or air purifying device 11 despite the air is brought to flow through impure air in the premises.

The air flow in the zone of clean air RZ is preferably 100–300 $m^3/h$ and the air discharge unit 15 is preferably located at a height of 0,5–1,5 m above the breathing zone A or similar. The cell body member 17 of the air discharge unit 15 is preferably designed such that it discharges or emits air consisting of laminar partial air flows. Moisture and/or gaseous medicine may when needed be added to the air in the first partial flow DS1 defining the clean air zone RZ.

It should also be mentioned that the heated air VL is brought to flow upwards such that it forms an upper layer of air L1 closest to the ceiling and this upper air layer L1 is brought to keep a temperature of preferably about 22° C. At the same time, air is sucked into the air treatment device 1 from a lower layer of air L2 closest to the floor 4 and having a lower temperature than the upper air layer L1, and said lower air layer L2 preferably has a temperature of about 20° C.

Air is brought to fall or descend at low speed and without turbulence from the upper air layer L1 to the lower air layer L2 preferably through an intermediate air layer L3 which might have a temperature of about 21° C.

Hereby, one can utilize a controlled zoning present in the premises for spreading the warm ("lighter") air along the ceiling and at the same time suck the cooler/impure air from floor level into the air treatment device 1. This results in that an air flow, free of turbulence, is generated when the purified air slowly descends in the premises. This effect intensifies the natural principle of sedimentation at which particles in the premises slowly fall or descend towards floor level provided that said premises lack turbulence-generating devices, e.g. air-mixing air supply units or similar.

The method described above and the device described above may vary within the scope of subsequent claims. An alternative embodiment not described above might include that the air purifying device 11 can purify air in another way than by filtration and the air therein may be treated with radiation or ionized or provided with moisture and/or medicine. About half the air taken in into the air treatment device 1 is discharged or emitted as cooled air KL and about half as heated air VL. The cooling device 13 may be another cooling device than a thermoelectric device. The air discharge unit 15 may have another form than the one described and shown and it may include one or more cell body members 17 and/or cell body layers. There may also be more than one air discharge unit 15. The breathing zone A or similar may be another area wherein clean air is needed and instead of air or in connection therewith, a protective gas may be used.

What is claimed is:

1. Method for providing clean air in premises, wherein impure air is received or taken in into an air treatment device (1) from lower portions of the premises and cleaned or purified therein, characterized by cooling a first partial flow (DS1) of air received or taken in into the air treatment device (1) to a temperature that is lower than a temperature measured outside the air treatment device (1), while heating a second partial flow (DS2) of air received or taken in into said air treatment device (1), bringing the cooled air (KL) in the first partial flow (DS1) to flow in such a way, through at least one cell body member (17) in at least one air discharge unit (15), that the rate of the cooled air becomes low and thereby substantial co-ejection of surrounding impure air to avoided to define at least one zone of clean air (RZ) in the premises beneath the air discharge unit (15), and discharging, through an air discharge opening (16), the heated air (VL) in the second partial flow (DS2) in an upwards direction such that said heated air (VL) rises in the premises at low speed.

2. Method according to claim 1, characterized by bringing the cooled air (KL) to define a zone of clean air (RZ) in the form of a breathing zone (A) for at least one person (18).

3. Method according to claim 2, characterized by bringing the cooled air (KL) to remove particles and/or mites from the person (18) in the breathing zone (A).

4. Method according to claim 2, characterized by cleaning or purifying the air in an air purifying device (11) such that it immediately thereafter has the desired degree of purity, and bringing the cooled air (KL) to have the same or substantially the same degree of purity in a central part (RZZ) of the breathing zone (A) as the clean air immediately after the air purifying device (11).

5. Method according to claim 2, characterized by measuring the air temperature in the premises in level with the breathing zone (A) and controlling a cooling device (13) for cooling air in dependence on the air temperature at said level.

6. Method according to claim 2, characterized by locating the air discharge unit (15) on a level 0,5–1,5 m above the breathing zone (A) of the person (18).

7. Method according to claim 2, characterized by adding to the cooled air (KL), which is brought to define the breathing zone (A), moisture and/or medicine.

8. Method according to claim 1, characterized by bringing the heated air (VL) to flow upwards such that it defines an upper layer of air (L1) closest to the ceiling, whereby said upper layer of air (L1) preferably is brought to keep a temperature of about 22° C., sucking air into the air treatment device (1) from a lower layer of air (L2) closest to the floor (4) in the premises having a lower temperature than the upper layer of air (L1), whereby said lower layer of air (L2) preferably is brought to keep a temperature of about 20° C., and bringing air to descend at low speed and free from turbulence from the upper layer of air (L1) to the lower layer of air (L2) preferably through an intermediate layer of air (L3) and without imparting substantially turbulence to the descending air.

9. Method according to claim 1, characterized by cooling the air (KL) in the partial flow (DS1) in a cooling device (13) which during operation generates heat, and heating the air (VL) in the second partial flow (DS2) by means of the heat generated by the cooling device (13).

10. Method according to claim 1, characterized by sucking impure air (OR) from lower parts of the premises into an air treatment device (1) by means of a fan device (12) forming part thereof, purifying said impure air (OR) in the air treatment device (1) by filtration therein, and dividing said purified air in two partial flows (DS1 and DS2) of which one (DS1) is cooled and the other (DS2) heated.

11. Method according to claim 1, characterized by bringing the air discharge unit (15) to discharge cooled air (KL) at one location in the premises and discharge heated air (VL) at another location in the premises.

12. Method according to claim 1, characterized by cooling the cooled air (KL) to a temperature which is 1–3° C. lower than the temperature of the air in the premises in the surroundings of the zone of clean air (RZ).

13. Method according to claim 1, characterized by discharging the cooled air (1(L) by the air discharge unit (15) at an air flow of 100–300 $m^3$/h.

14. Method according to claim 1, characterized by bringing the cell body member (17) of the air discharge unit (15) to discharge or emit cooled air (KL) consisting of laminar partial air flows and brought to flow downwards and downwards/outwards relative to the air discharge unit (15).

15. Method according to claim 1, characterized by taking in impure air (OR) into the air treatment device (1) from such parts of the premises located at a lower level than the zone of clean air (RZ).

16. Method according to claim 1, characterized by discharging the heated air (VL) at a location beside and at a level above the clean air zone (RZ).

17. Method according to claim 1, characterized by purifying impure air (OR) in the air treatment device (1) by filtration therein.

18. Method according to claim 1, characterized by radiation treating air in the air treatment device (1).

19. Method according to claim 1, characterized by ionizing air in the air treatment device (1).

20. Method according to claim 1, characterized by discharging about half the air taken in into the air treatment device (1) as cooled air (KL) and about half as heated air (VL).

21. Method according to claim 1, characterized by generating with the heated air (VL) a zone of clean air (RZ) in the form of a working area.

22. Air treatment device for providing clean air in premises, wherein the air treatment device (1) includes means (8, 9) for taking in impure air (OR) from lower parts of the premises, and wherein the air treatment device (1) further includes an air purifying device (11) for cleaning said impure air (OR) at least one air discharge unit (15) having at least one cell body member (17) which is provided to emit or discharge cooled air (KL) downwards in the premises, characterized in that the air treatment device (1) also includes an air passage (10) which at least partly is divided in at least first and second passage branches (10*a*, 10*b*) for first and second partial flows (DS1 and DS2) of air taken in into the air treatment device (1), that in a first passage branch (10*a*) there is provided a cooling device (13) for cooling the first partial flow (DS1) flowing through said first passage branch (10*a*)

that said first passage branch (10*a*) communicates with the air discharge unit (15) to guide cooled air (KL) thereto, that in the second passage branch (10*b*) there is provided a heating device (14) for heating the second partial flow (DS2) flowing through said second passage branch (10*b*), that said second passage branch (10*b*) communicates with means (16) for letting out or discharge warm air (VL) from the heating device (14), that said means (16) for discharging warm air (VL) are located at substantial distance from the air discharge unit (15) such that the cooled air (KL) leaving the air discharge unit (15) and the hot or warm air (VL) leaving said means (16) are discharged into different parts of the premises, that the cooling device (13) is adapted to cool air to such a temperature relative to the temperature of the air in the premises into which the cooled air (KL) shall be discharged, that said cooled air (KL) slowly descends without substantial co-ejection of surrounding impure air for defining a clean air zone (RZ) beneath the air discharge unit (15), and that the heating device (14) is adapted to heat air to such a temperature relative to the temperature of the air in the premises into which the hot air (VL) is discharged, that said warm air (VL) slowly rises upwards towards the ceiling regions (TR) of the premises.

23. Air treatment device according to claim 22, characterized in that the heating device (14) is a device which utilizes heat discharged by the cooling device (13) to warm up the air in the second passage branch (10*b*).

24. Air treatment device according to claim 22, characterized in that at least one transmitter (20) is provided to measure the air temperature in the premises in level or substantially in level with a breathing zone (A) or similar defined by the clean air zone (RZ), and that a control device (RC) is provided to control the cooling device (13) to cool air (KL) in dependence of the temperature measured by the transmitter (20) at said level.

25. Air treatment device according to claim 24, characterized in that the control device (RC) controls the cooling device (13) to cool air (KL) to a temperature which is 1–3° C. lower than the air temperature measured by the transmitter (20) in the premises.

26. Air treatment device according to claim 22, characterized in that the air treatment device (1) is adapted to discharge a cooled partial flow (1(L) at an air flow rate of 100–300 $m^3$/h.

27. Air treatment device according to claim 22, characterized in that the air discharge unit (15) is situated at a height or level of 0,5–1,5 m above a breathing zone (A) or similar.

28. Air treatment device according to claim 22, characterized in that the cell body member (17) of the air discharge unit (15) is designed to discharge or emit laminar air flows in downwards direction.

29. Air treatment device according to claim 22, wherein the cell body member (17) of the air discharge unit (15) has a substantially semi-spherical shape, characterized in that said cell body member (17) has an outer porous cell body layer (17*a*) and an inner porous cell body layer (17*b*) and that said outer cell body layer (17*a*) is harder and has larger pores than said inner cell body layer (17*b*).

30. Air treatment device according to claim 22, characterized in that it has at least one air intake (8 and/or 9) for taking in impure air (OR) to the cooling device (13) from floor level of the premises.

31. Air treatment device according to claim 22, characterized in that an air purifying device for purifying impure air (OR) is a filter device (11*a* and/or 11*b*).

32. Air treatment device according to claim 22, characterized in that it is adapted to treat air by radiation.

33. Air treatment device according to claim 22, characterized in that it is adapted to ionize air.

34. Air treatment device according to claim 22, characterized in that it is adapted to generate a zone of clean air (RZ) in the form of a breathing zone (A) for one person (18).

35. Air treatment device according to claim 34, characterized in that moisture and/or medicine is added to the cooled air (KL) defining the breathing zone (A).

36. Air treatment device according to claim 22, characterized in that it includes a fan device (12) for sucking in air into and bring it to flow through the air treatment device (1).

37. Air treatment device according to claim 22, characterized in that it includes a column (5) having a vertical member (6) and a laterally directed member (7), that the vertical member (6) of the column (5) includes the cooling device (13) and the heating device (14), an air purifying device (11) and a fan device (12), that the laterally directed member (7) of the column (5) includes the air discharge unit (15), that an air intake opening (8 and/or 9) for taking in air into the air purifying device (11), the fan device (12), the cooling device (13) and the heating device (14) is located down below in the vertical member (6), and that said means for discharge of warm air (VL) is at least one air discharge opening (16) which is located at the top in the vertical member (6) and on an opposite side thereof relative to the air discharge unit (15).

38. Air treatment device according to claim 22, characterized in that it is mobile for being movable in the premises.

39. Air treatment device according to claim 22, characterized in that the cooling device (13) is a thermoelectric device with Peltier-effect.

* * * * *

UNITED STATES PATENT AND TRADEMARK OFFICE

CERTIFICATE OF CORRECTION

PATENT NO. : 6,702,662 B2
DATED : March 9, 2004
INVENTOR(S) : Jan Kristensson

It is certified that error appears in the above-identified patent and that said Letters Patent is hereby corrected as shown below:

Column 5,
Line 29, after "air" change "(1(L)" to -- (KL) --.

Column 6,
Line 56, after "flow" change "(1(L)" to -- (KL) --.

Signed and Sealed this

Second Day of November, 2004

JON W. DUDAS
*Director of the United States Patent and Trademark Office*